United States Patent [19]

Seo

[11] 4,241,632

[45] Dec. 30, 1980

[54] BLANKING MACHINE FOR BLANKING HOLES IN SHEET OF METAL

[75] Inventor: Osamu Seo, Komatsu, Japan

[73] Assignee: Kabushiki Kaisha Komatsu Seisakusho, Tokyo, Japan

[21] Appl. No.: 56,288

[22] Filed: Jul. 10, 1979

[30] Foreign Application Priority Data

Jul. 10, 1978 [JP] Japan ..... 53-82949

[51] Int. Cl.[3] ..... B26D 5/04

[52] U.S. Cl. ..... 83/560; 83/34; 83/217; 83/558; 91/167 R; 91/170 R

[58] Field of Search ..... 83/558, 560, 556, 217, 83/34; 91/167 R, 170 R, 508

[56] References Cited

U.S. PATENT DOCUMENTS

| | | | |
|---|---|---|---|
| 2,761,473 | 9/1956 | Denton | 91/167 R X |
| 3,712,161 | 1/1973 | Valente | 83/558 X |
| 3,738,227 | 6/1973 | Bitzer et al. | 91/167 R |
| 3,762,260 | 10/1973 | Taniguchi | 83/558 X |
| 3,785,235 | 1/1974 | Peddinghaus et al. | 83/558 X |

FOREIGN PATENT DOCUMENTS

| | | |
|---|---|---|
| 48-44910 | 12/1973 | Japan . |
| 49-8373 | 2/1974 | Japan . |

*Primary Examiner*—Frank T. Yost

*Attorney, Agent, or Firm*—Armstrong, Nikaido, Marmelstein & Kubovcik

[57] ABSTRACT

A blanking machine for blanking holes in a sheet of metal in a zigzag fashion comprising a bolster, a pair of rails, fixedly secured to the bolster extending in a direction right angles to the feeding direction of the sheet of metal to be blanked, a lower die set slidably mounted on the rails, a die fixedly secured to the lower die set, an upper die set having a punch mounted thereon opposite the die, the upper and the lower die sets being coupled together, a hydraulic cylinder having a plurality of pressure chambers formed therein, a transmission mechanism connected to a piston rod of the hydraulic cylinder, and a connecting rod for connecting the transmission mechanism to the upper or lower die set.

4 Claims, 19 Drawing Figures

| | SOL1 | SOL2 | SOL3 |
|---|---|---|---|
| FIG. 6A | ○ | ○ | — |
| FIG. 7A | — | — | — |
| FIG. 7B | ○ | — | — |

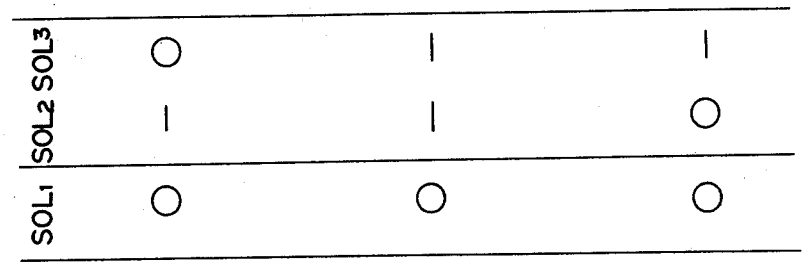
FIG. 8A
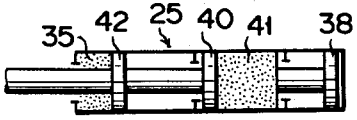
FIG. 8B
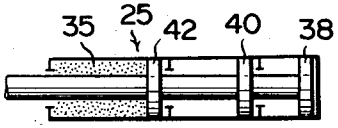
FIG. 8C
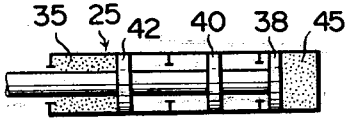
FIG. 8D
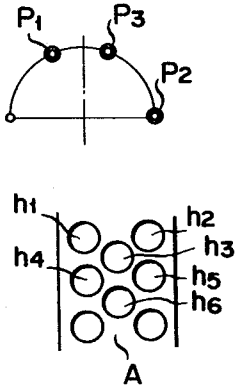

| | SOL1 | SOL2 | SOL3 |
|---|---|---|---|
| | — | — | ○ |
| | ○ | ○ | — |
| | ○ | — | — |
| | ○ | — | ○ |

BLANKING MACHINE FOR BLANKING HOLES IN SHEET OF METAL

BACKGROUND OF THE INVENTION

This invention relates to a blanking machine adapted to blank holes in plural rows in a metal sheet.

In case of blanking holes, for example, circular holes in plural rows in a metal sheet, an improved yield of the material can be obtained by blanking holes in a zigzag form as compared with blanking holes in parallel relationship. For this reason, the method of blanking holes in two rows in a zigzag form has been employed; however, an improved yield of materials and efficiency can sometimes be obtained by blanking holes in more than three rows depending on the width of the metal sheet. However, the conventional method has been disadvantageous in that it is difficult to blank holes in more than three rows in a zigzag form, and also troublesome operation is required.

SUMMARY OF THE INVENTION

It is therefore an object of the present invention to provide a blanking machine for blanking holes in a sheet of metal which is capable of overcoming the above noted problems.

Another object of the present invention is to provide a blanking machine for blanking holes in a sheet of metal wherein holes are blanked in a plurality of rows in a zigzag fashion automatically by using a hydraulic cylinder having a plurality of pressure chambers. In accordance with an aspect of the present invention, there is provided a blanking machine for blanking holes in a sheet of metal, comprising: a bolster; a pair of rails fixedly secured to said bolster; said rails extending in a direction right angles to the feeding direction of the sheet of metal to be blanked; a lower die set slidably mounted on said rails; a die fixedly secured to said lower die set; an upper die set having a punch mounted thereon opposite said die; coupling means for coupling said upper die set with said lower die set allowing said upper die set to move on said rails together with said lower die set; hydraulic cylinder means having a plurality of pressure chambers formed therein defined by a cylinder barrel and partition walls, the length of said pressure chambers being different from one another, each pressure chamber having mounted therein a piston and a piston rod, and each partition wall and rod-end of said cylinder barrel having holes formed therein allowing the piston rods to slide therein, each piston rod except the last one being adapted to contact with the adjacent piston; connecting rod means connected to said lower or upper die set at one end thereof; and transmission means connected to the other end of said connecting rod means at one end thereof, the other end of which is connected to said last piston rod whereby said lower and upper die sets are moved on said rails by the actuation of said hydraulic cylinder means.

The above and other objects, features and advantages of the present invention will be readily apparent from the following description taken in conjunction with the accompanying drawings.

BRIEF DESCRIPTION OF THE DRAWINGS

FIGS. 8A to 8C are similar to FIG. 6A but showing a mode of operation for a triple-row blanking;

FIG. 8D is similar to FIG. 6B but showing a triple-row blanking;

DETAILED DESCRIPTION OF THE INVENTION

Figure 1:
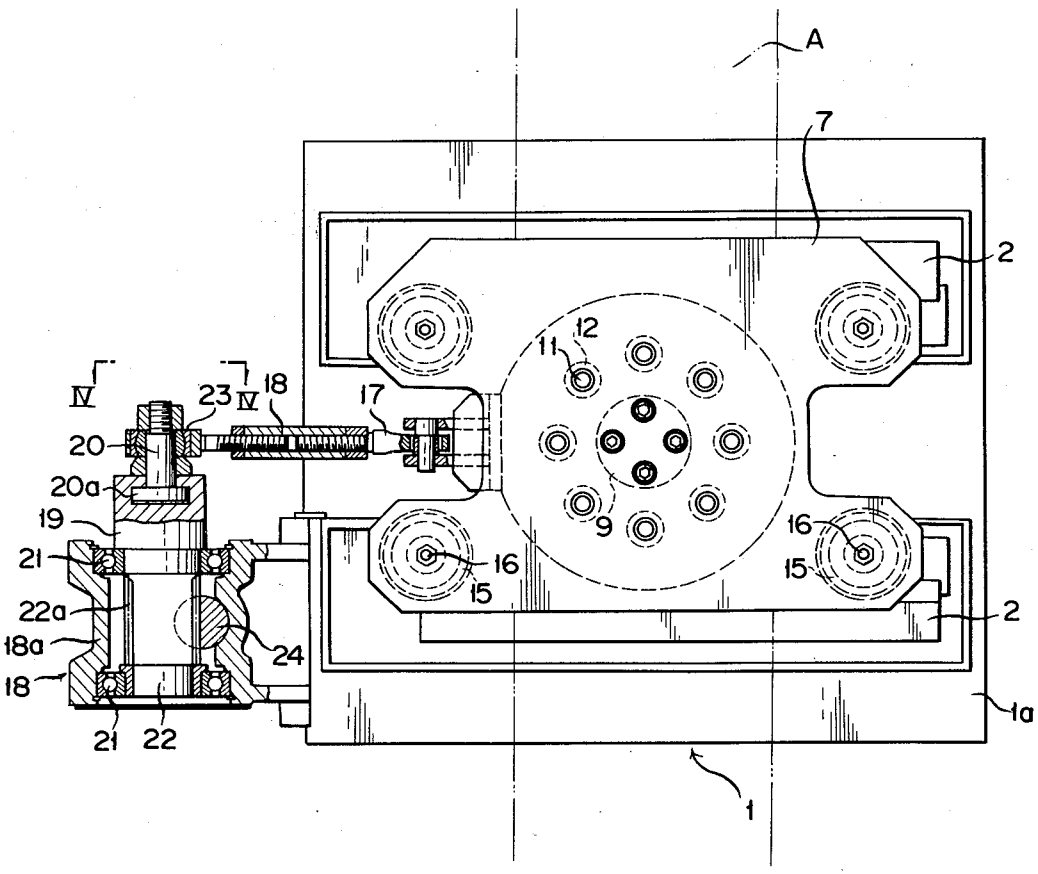
FIG. 1 is a top plan view of a blanking machine according to the present invention.
Figure 2:
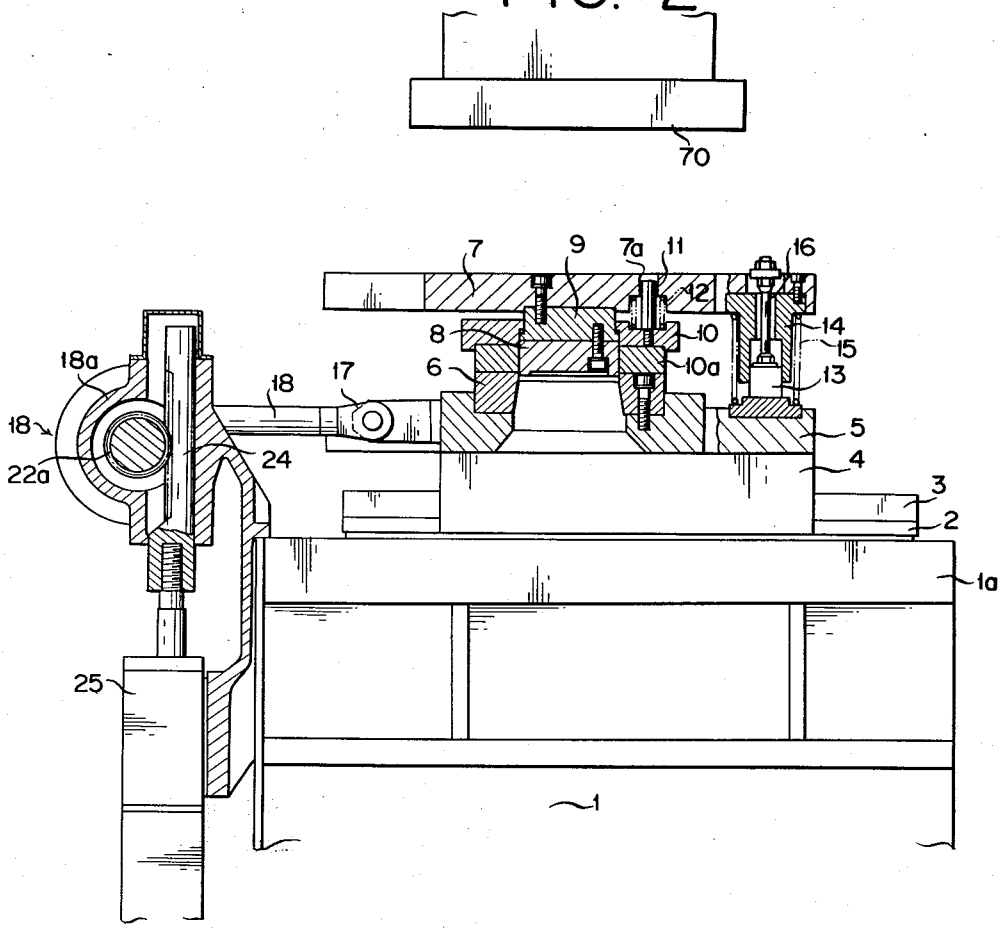
FIG. 2 is a longitudinal cross-sectional view of FIG. 1.
Figure 3:
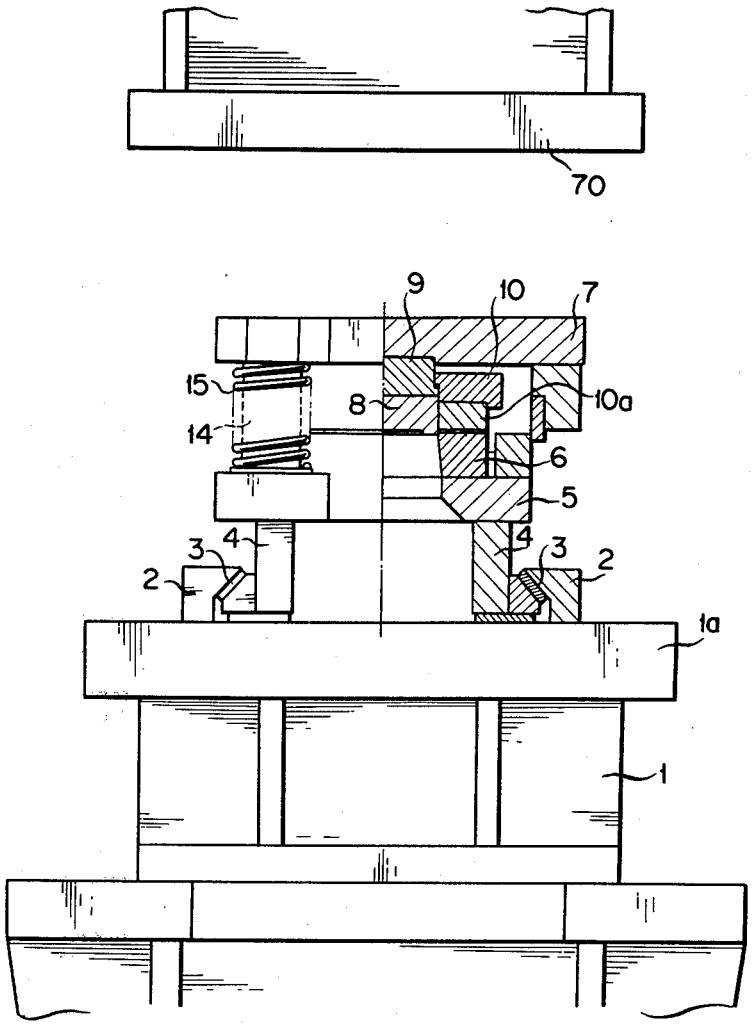
FIG. 3 is a side elevational view partly in cross-section of FIG. 1.

The present invention will now be described with reference to the accompanying drawings. In the drawings, reference numeral 1*a* denotes a bolster forming a body 1 of this machine. Guide rails 2 are installed on the bolster 1*a* and extend in a direction at right angles to the direction of supply of a metal sheet A. Slidably carried inside the guide rails 2 and through a liner 3 are legs 4. A lower die set 5 is fixedly secured to the leg 4. Fixedly secured to the central part of the lower die set 5 is a die 6. Located above the die 6 is a punch 8 which is attached to an upper die set 7. The punch 8 is fixedly secured through a plate 9 to the lower face of the upper die set 7. A stripper 10 is loosely fitted in the periphery of the plate 9. Projecting from the upper face of the stripper 10 and located in the periphery of the plate 9 are a plurality of guide pins 11, the upper ends of which are slidably inserted in guide holes 7*a* formed in the upper die set 7 so as to guide upward and downward movements of the stripper 10. Each of the guide pins 11 guiding the stripper 10 is provided with a compression spring 12 for downwardly biasing the stripper 10. Fixedly secured to the lower portion of the stripper 10 is a stripper plate 10*a* which is adapted to abut against the upper surface of the die 6 to clamp a metal sheet "A" to be blanked between the stripper plate 10*a* and the die 6. Further, the lower die set 5 has upstanding guide pins 13 at plural places, for example, four places, each guide pin 13 being inserted in the lower end of each of freely slidably posts 14 which are fixedly secured to the lower face of the upper die set 7 so as to guide the upward and downward movements of the die set 7. Each of the posts 14 is loaded by a compression spring 15 which biases the upper die set 7 upwardly. Reference numeral 16 denotes a stopper adapted to stop the upper die set 7 at an upper limit.

Figure 5:
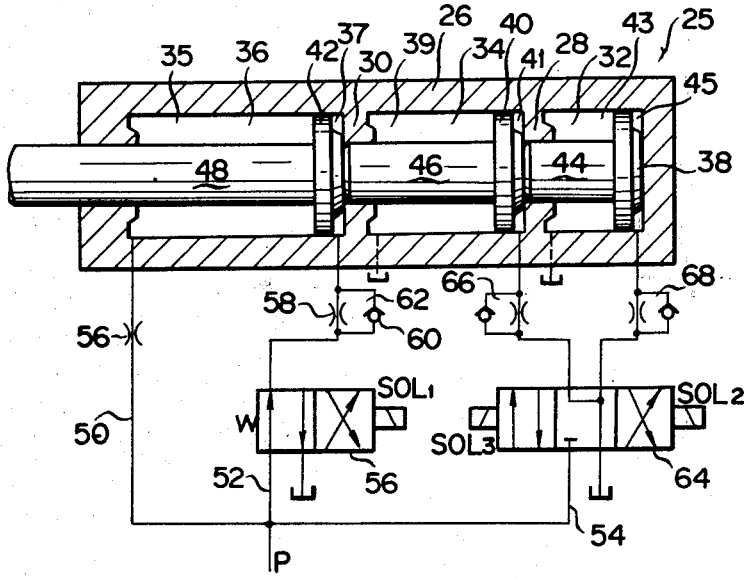
FIG. 5 is a cross-sectional view of a hydraulic cylinder having a plurality of pressure chambers with a control circuit connected thereto.

Whilst, pivotally connected to one side of the lower die set 5 is one end of a connecting rod 17, which has a turnbuckle 18 at the intermediate portion thereof so that its length between both ends thereof can be properly adjusted. The other end of the connecting rod 17 is connected through a movable pin 20 to a turning arm 19 of a transmission mechanism 18. The transmission mechanism 18 has a casing 18*a* fitted to one side of the bolster 1*a*. An arm shaft 22 is supported through bearings 21 within the casing 18*a*. Fixedly secured to one end of the arm shaft 22 is one end of the above-mentioned turning arm 19. The turning arm 19 has a longitudinally extending guide groove 19*a* formed therein in which head 20*a* of the above-mentioned movable pin 20 is slidably inserted. Further, pivotally connected to the leading end of the movable pin 20 through a ball bearing 23 is the other end of the aforementioned connecting rod 17. Further, the above-mentioned arm shaft 22 has a pinion 22*a* formed thereon which is adapted to engage with a rack 24 carried within the casing 18*a* so as to be moved freely in the vertical direction. Connected to the lower end of the rack 24 is the leading end of a piston rod 48 of a multi-stage cylinder 25. As shown in FIG. 5, the multi-stage cylinder 25 has, for example, three pressure chambers 32, 34 and 36 divided by partition walls 28 and 30 within its cylinder barrel 26. The lengths of the pressure chambers 32, 34 and 36 are determined such that if the length of the pressure chamber 32 is set at 1, those of the pressure chambers 34 and 36 are 2 and 3, respectively. The pressure chambers 32, 34 and 36 accommodate pistons 38, 40 and 42 therein.

When the pistons 38, 40 and 42 are located at its stroke end in the pressure chambers 32, 34 and 36 or the right-most end in the drawing, the leading end of piston rod 44 projecting from the piston 38 extends through the partition wall 28 and abuts against the piston 40, and the leading end of piston rod 46 of the piston 40 extends through the partition wall 30 and abuts against the piston 42. Further, the piston rod 48 of the piston 42 passes through the end wall of the cylinder barrel 26 and its leading end is connected to the lower end of the rack 24. Pipings are connected to rod-end chambers and bottom-end chambers of the pressure chambers 32, 34 and 36. The chambers located opposite to the rod-end chambers of the cylinder will be referred to in this specification as bottom-end chambers.

Stating in brief, the fluid pressure P supplied by a pressure source not shown is introduced into branch conduits 50, 52 and 54. The branch conduit 50 is connected through a restrictor 56 to a rod-end chamber 35 of the pressure chamber 36, and the branch conduit 52 is connected through a solenoid valve 56 and a flow metering valve 62 consisting of a restrictor 58 and a check valve 60 to a bottom-end chamber 37 of the pressure chamber 36. Further, the remaining branch conduit 54 is connected through a solenoid valve 64 and a flow metering valve 66 or 68 to either a bottom-end chamber 41 of the pressure chamber 34 or a bottom-end chamber 45 of the pressure chamber 32. Rod-end chambers 43 and 39 of the pressure chambers 32 and 34 are connected to the drain, respectively.

Reference numeral 70 denotes a ram of a press not shown, which is adapted to urge the upper die set 7.

Figure 4:
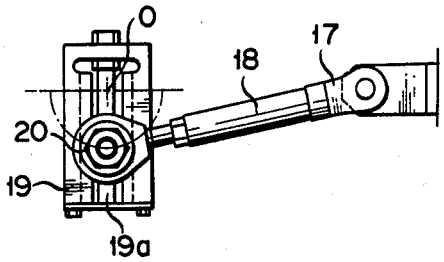
FIG. 4 is a view taken along the line IV—IV of FIG. 1 with a locus of a movable pin being disclosed in a semicircular dot-and-dash line.
Figure 6A:
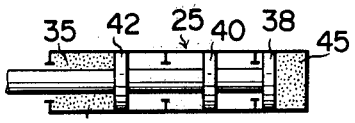
FIG. 6A is a simplified view of a hydraulic cylinder showing a mode of operation for a single row blanking.
Figure 6B:
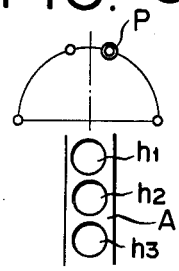
FIG. 6B is an explanational view for a single row blanking in a sheet of metal with a position of the movable pin being identified by P.

In case of blanking holes, for example, in a single row in the metal sheet "A" which is inserted between the die 6 and the punch 8 in the direction at right angles to the direction of movement of the upper and lower die sets 5 and 7, $SOL_1$ of the solenoid valve 56 and $SOL_2$ of the solenoid valve 64 are turned on. As a result, the pressure is introduced into the rod-end chamber 35 of the pressure chamber 36 and the bottom-end chamber 45 of the pressure chamber 32 as shown in FIG. 6. At that time, because of a difference in pressure receiving area of the piston 42 within the rod-end chamber 35 and the piston 38 within the bottom-end chamber 45, the pistons 40 and 42 are urged by the piston 38 to the left hand by an amount equivalent to one stroke thereof or one pitch to move the rack 24 upwards and turn the pinion 22*a* thereby turning the turning arm 19 fixedly secured to the arm shaft 22 and enabling the movable pin 20 to reach the position shown by "P" in FIG. 6B. Consequently, the upper and lower die sets 5 and 7 are moved on the guide rails 2 by one pitch so that the die 6 and the punch 8 can reach the central part of the metal sheet A. Thus, moving the upper die set 7 upwardly and downwardly by the action of the ram 70 at this position while the metal sheet A is being fed enables holes $h_1$, $h_2$ . . . to be blanked in the metal sheet A between the die 6 and the punch 8. Referring to FIG. 4, when the pinion 22*a* is rotated, the turning arm 19 will rotate about the center "O" of the arm shaft 22 and the movable pin 20 will draw a semi-circular locus as shown by a dash-and-dot line. Thus, the upper and lower die sets 5 and 7 can be moved on the guide rails 2.

Figure 7A:
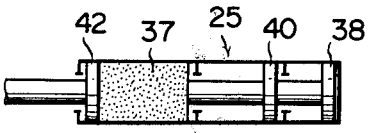
FIGS. 7A and 7B are similar to FIG. 6A but showing a mode of operation for a double-row blanking.
Figure 7B:
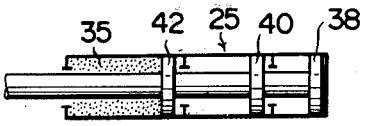
Figure 7C:
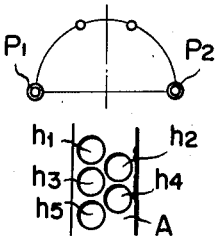
FIG. 7C is similar to FIG. 6B but showing a double-row blanking.

When it is desired to blank holes in two rows, $SOL_1$ of the solenoid valve 56 is turned off, and both $SOL_2$ and $SOL_3$ of the solenoid valve 64 are turned off. As a result, as shown in FIG. 7A, the fluid pressure is introduced into the bottom-end chamber 37 of the pressure chamber 36 so that the piston 42 is moved by three pitches thereby moving the rack 24 upwards. Consequently, the movable pin 20 will assume the position $P_1$ in FIG. 7C. Under such condition, the ram 70 is moved downwards to blank a hole $h_1$. Then for second step $SOL_1$ of the solenoid valve 56 is turned on with advancement of the metal sheet A. Consequently, the fluid pressure is introduced into the rod-end chamber 35 of the pressure chamber 36 so that the piston 42 reaches its stroke end and the movable pin 20 will assume the position as shown by $P_2$ in FIG. 7C thereby allowing the upper and lower die sets 5 and 7 to move on the guide rails 2. By moving the ram 70 downwards under this condition, a hole $h_2$ can be blanked. By repeating the above-mentioned actions in turn, two rows of holes $h_1$, $h_2$, $h_3$—can be blanked in a zig-zag fashion.

When it is desired to blank holes in three rows in the metal sheet A, $SOL_1$ of the solenoid valve 56 is turned on and $SOL_3$ of the solenoid valve 64 is turned on as well. As a result, the fluid pressure is introduced into the bottom-end chamber 41 of the pressure chamber 34 so as to move the piston 40 by two pitches, and the movable pin 20 will assume the position $P_1$ in FIG. 8D thereby moving the upper and lower die sets 5 and 7. Thus, by moving the ram 70 downwards at this position, a hole $h_1$ can be blanked. Then as a second step, $SOL_1$ of the solenoid valve 56 is turned on and both $SOL_2$ and $SOL_3$ of the solenoid valve 64 are turned off, so the pistons 38, 40 and 42 are allowed to reach their stroke ends by the action of the fluid pressure in the rod-end chamber 35 of the pressure chamber 36 thereby enabling the movable pin 20 to assume the position $P_2$ in FIG. 8D. Therefore, by moving the ram 70 downwards at this position, a hole $h_2$ can be blanked.

Subsequently, as a third step $SOL_1$ of the solenoid valve 56 is turned on and $SOL_2$ of the solenoid valve 64 is turned on, therefore the fluid pressure is introduced into the bottom-end chamber 45 of the pressure chamber 32 so as to advance the pistons 38, 40 and 42 by one pitch as shown in FIG. 8C, and so the movable pin 20 will assume the position as shown by $P_3$ in FIG. 8D. Therefore, by moving the ram 70 downwards at this position a hold $h_3$ can be blanked. By repeating the aforementioned actions, three rows of holes $h_1$, $h_2$, $h_3$—can be blanked in a zigzag fashion.

Figure 9A:
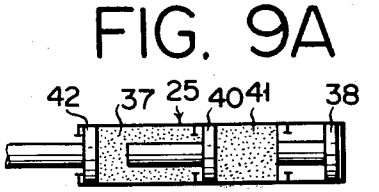
FIGS. 9A to 9D are similar to FIG. 6A but showing a mode of operation for a quadruple-row blanking.
Figure 9B:
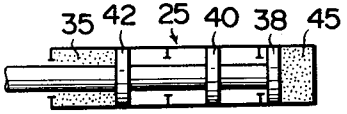
Figure 9C:
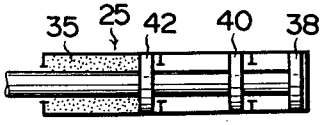
Figure 9D:
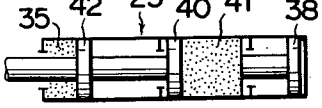
Figure 9E:
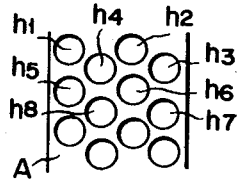
FIG. 9E is similar to FIG. 6B but showing a quadruple-row blanking.

When it is desired to blank holes in four rows in a metal sheet, $SOL_1$ of the solenoid valve 56 is turned off and $SOL_3$ of the solenoid valve 64 is turned on. As a result, the fluid pressure is introduced into the bottom-end chambers 41 and 37 of the pressure chambers 34 and 36 as shown in FIG. 9A so that the pistons 40 and 42 will move leftwards and the movable pin 20 will assume the position $P_1$ in the FIG. 9E. Thus, by moving the ram 70 downwards at this position, a hole $h_1$ can be blanked. Then as a second step, $SOL_1$ of the solenoid valve 56 is turned on and $SOL_2$ of the solenoid valve 64 is turned on, therefore the fluid pressure is introduced into the bottom-end chamber 45 of the pressure chamber 32 so that the movable pin 20 can assume the position $P_2$ thereby enabling a hole $h_2$ to be blanked. As a third step, when $SOL_1$ of the solenoid valve 56 is turned on and both $SOL_2$ and $SOL_3$ of the solenoid valve 64 are turned off, the pistons 38, 40 and 42 will move back to their stroke ends and the movable pin 20 will assume the position $P_3$. Therefore, a hole $h_3$ can be blanked. Further, as a fourth step when $SOL_1$ of the solenoid valve 56 is turned on and $SOL_3$ of the solenoid valve 64 is turned on too, the fluid pressure is introduced into the bottom-end chamber 41 of the pressure chamber 34 so as to advance the pistons 40 and 42 as shown in FIG. 9D, and the movable pin 20 will assume the position as shown by $P_4$ thereby enabling a hole $h_4$ to be blanked. By repeating the aforementioned actions thereafter, four rows of holes $h_1$, $h_2$, $h_3$, $h_4$—can be blanked in a zigzag fashion.

Further, if the number of pistons of the multi-stage cylinder 25 is increased in accordance with the number of rows of the holes to be blanked, blanking holes in desired plural rows can be made.

As mentioned in detail hereinabove, according to the present invention, by moving the upper and lower die sets stepwise by the action of the multi-stage cylinder in the direction at right angles to the direction of movement of the metal sheet to be blanked, plural rows of holes can be blanked in a zigzag form in proportion to the width of the metal sheet.

Therefore, selection of the number of rows of holes to be blanked in proportion to the width of the metal sheet enables efficient and continuous blanking holes to be effected and also an improved yield of materials to be obtained. Further, because the upper and lower die sets can be moved by a predetermined amount only by controlling valves such as solenoid valves connected to the multi-stage cylinder, holes in plural rows can be blanked by a relatively simple arrangement and also an improved effect can be obtained in that the number of rows of holes to be blanked can be changed readily only by changing the sequence of operation of the valves.

While the invention has been described and shown with particular reference to the preferred embodiment, it will be apparent that variations might be possible that would fall within the scope of the present invention, which is not intended to be limited except as defined in the following claims.

What I claim is:

1. A blanking machine for blanking holes in a sheet of metal, comprising:

a bolster;

a pair of rails fixedly secured to said bolster; said rails extending in a direction right angles to the feeding direction of the sheet of metal to be blanked;

a lower die set slidably mounted on said rails;

a die fixedly secured to said lower die set;

an upper die set having a punch mounted thereon opposite said die;

coupling means for coupling said upper die set with said lower die set allowing said upper die set to move on said rails together with said lower die set;

hydraulic cylinder means having a plurality of pressure chambers formed therein defined by a cylinder barrel and partition walls, the length of said pressure chambers being different from one another, each pressure chamber having mounted therein a piston and a piston rod, and each partition wall and rod-end of said cylinder barrel having holes formed therein allowing the piston rods to slide therein, each piston rod except the last one being adapted to contact with the adjacent piston;

connecting rod means connected to said lower or upper die set at one end thereof; and transmission means connected to the other end of said connecting rod means at one end thereof, the other end of which is connected to said last piston rod whereby said lower and upper die sets are moved on said rails by the actuation of said hydraulic cylinder means.

2. A blanking machine as claimed in claim 1 wherein said transmission means comprises a rack connected to said last piston rod, shaft means having a pinion formed thereon, the pinion being adapted to engage with said rack, an arm member fixedly secured to said shaft means, said arm member having a groove formed therein, and a pin slidably mounted in the groove of said arm member and connected to said connecting rod means.

3. A blanking machine as claimed in claim 1 wherein said hydraulic cylinder means is mounted vertically on the side of said bolster and wherein said transmission means being adapted to translate a vertical movement of said piston rod into a horizontal movement of said upper and lower die sets.

4. A blanking machine as claimed in claim 1, 2 or 3 further comprising a hydraulic circuit for controlling said hydraulic cylinder means, said hydraulic circuit including at least one solenoid-operated directional valve.

* * * * *